United States Patent [19]

Hoolt

[11] Patent Number: 5,028,074

[45] Date of Patent: Jul. 2, 1991

[54] PRINTED WORK INCLUDING AN ADHERED DETACHABLE UNIT

[75] Inventor: Albertus G. Hoolt, Purmerend, Netherlands

[73] Assignee: Zara Business Inc. Panama, Val Sainte-Croix, Luxembourg

[21] Appl. No.: 526,385

[22] Filed: May 21, 1990

[30] Foreign Application Priority Data

May 25, 1989 [DE] Fed. Rep. of Germany ... 8906448[U]

[51] Int. Cl.[5] ..... B42D 1/00; B42D 13/00; B42F 3/00

[52] U.S. Cl. ..... 281/38; 281/15.1; 281/21.1

[58] Field of Search ..... 281/38, 15.1, 21.1

[56] References Cited

U.S. PATENT DOCUMENTS

| | | | |
|---|---|---|---|
| 916,034 | 3/1909 | Scholes | 281/38 |
| 916,036 | 3/1909 | Scholes | 281/38 |
| 1,733,048 | 10/1929 | Beale | 281/38 |
| 4,596,407 | 6/1986 | Suska | 281/38 X |
| 4,667,983 | 5/1987 | Spolander | 281/15.1 |

FOREIGN PATENT DOCUMENTS

| | | | |
|---|---|---|---|
| 154330 | 11/1902 | Fed. Rep. of Germany | 281/38 |
| 1962992 | 12/1969 | Fed. Rep. of Germany | 281/21.1 |

*Primary Examiner*—Paul A. Bell
*Attorney, Agent, or Firm*—Auslander & Thomas

[57] ABSTRACT

There is disclosed a periodical with a plurality of leaf-like pages bound together like a book and held together at a spine. In such an arrangement at least some of the leaves are adhered together as a unit which is detachable from the spine and can be detached from the periodical and preserved separately.

5 Claims, 2 Drawing Sheets

PRINTED WORK INCLUDING AN ADHERED DETACHABLE UNIT

BACKGROUND OF THE INVENTION

Field of Invention

The invention relates to a periodical or similar printed work which comprises a plurality of leaf-like pages bound together as a book and held together at a spine.

The printed work can be a periodical, but equally well it could be a newspaper, a brochure, a prospectus or even a book. The individual pages could be held together by orthodox book-binding technology such as stitching, binding, the Lumbeck binding process and so on.

It is desirable, in certain publications or other printed works, to provide inserts which the reader can extract from the publication in question and can preserve separately in order to be able to retain certain items of information of lasting value without having to keep the entire periodical. Corresponding pages could be provided with a set of securing holes in order to be able to remove the leaves from the periodical directly in the right order and collect them together in a file. Where the items of information to be extracted from a periodical are arranged on individual pages it is not difficult to extract the relevant pages individually from the periodical, for example if the pages are bound in with a row of perforations extending parallel to the spine. However, where the items of information to be extracted from the periodical are more extensive, so that for example they fill four or more pages, it is often unsatisfactory to extract the pages individually because the related items of information could then in some circumstances become separated from one another.

SUMMARY OF THE INVENTION

It is the aim of the invention to provide a periodical, publication or book from which items of information which extend over more than two pages can be extracted in such a way that these items remain together and can be easily detached and filed away.

In a preferred embodiment the present invention provides a publication or book with a plurality of leaves bound together as a book and held at a spine, which includes at least some leaves adhered together as a unit, detachable from the spine. The leaves having common means and perforations extending parallel to the spine and are adhered together in the regions of the perforations.

The periodical, publication or book may include the leaves including lateral strips and the adhering of the leaves in the region of the lateral strips. One of the leaves of the detachable unit may be wider and connected as a unit. The units may include more than one upper leaf and more than one lower leaf with the lower leaves wider than the upper leaves. The leaves may be a single folded sheet superimposed upon itself.

By virtue of the present invention there is provided preferred embodiments of a periodical, brochure or even a book, from which individual predetermined pages can be cleanly removed and put away in a separate file. These pages are preferably bound together as a multiple unit, i.e. there are at least two superimposed pages adhered together in the region of the binding edge or in the region of the perforations, so that at least two respective successive pages form a unit which can be detached as a whole from the periodical or the like and filed away.

The leaves bound together to form a unit are preferably arranged so that the lower or lowermost sheet is wider than the upper sheets adhered to it. Accordingly one can provide on the outer edge of the lowermost page an item of information which is also visible when the leaf lying above it is not turned back.

Such a combination of at least two superimposed leaves of a printed publication is obtained by a novel folding technique, namely in that two sheets of the same format are laid one on top of the other, but offset and are adhered together in their central regions and the whole assembly is then folded at its central region. The fold corresponds to the spine of the bound printed work. Laterally of the fold there is provided a row of perforations extending parallel to it and adjacent to that, an adhesive strip. The folded signature thus formed, comprising several sheets and thereby pages, is preferably subsequently provided with a row of attachment holes. The row of perforations can also be provided after adhering and folding. The whole assembly can then be handed over for binding into the desired periodical or printed work.

Of the superimposed sheets formed from two or more signatures of each sheet unit, the un-offset sheet units or the upper sheets are smaller than the offset or lowermost sheet.

By virtue of the invention there is provided the possibility of extracting portions from printed works such as periodicals and binding them separately, allowing different items of information to be collected together easily and preserved.

DETAILED DESCRIPTION

Figure 1:
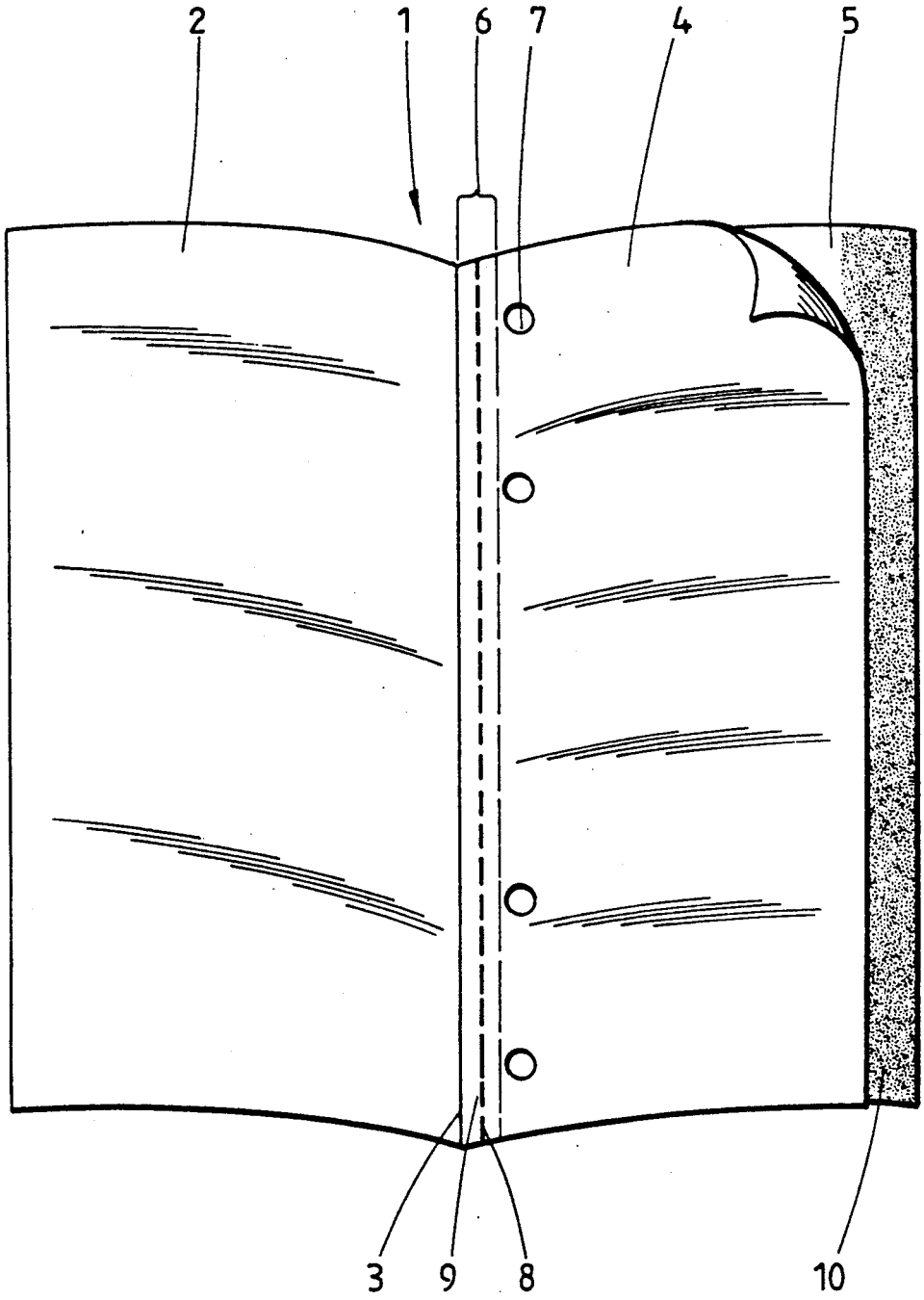
In FIG. 1 an embodiment by way of example of a periodical laid out in accordance with the invention is illustrated in the drawing, in which the Figure is a plan view of the opened-out periodical, from which a sheet unit, which is removable in accordance with the invention, can be seen.

The periodical 1 contains a plurality of leaves 2 which are connected together at a central spine 3. In the embodiment illustrated by way of example the leaves 2 are adhered together at their corresponding edges by Lumbeck binding process at the spine 3.

Individual directly mutually adjacent leaves 4 and 5 are of special format and connected together to form a unit. The leaves 4 and 5 in this arrangement are adhered together in the region of the spine 3 and, therefore in the region of a strip 6. Directly adjacent to this strip 6 holes 7 are provided in the two leaves 4 and 5, extending through the leaves which holes 7 may be used for binding the leaves together in a file. In the region of the strip 6 the two superimposed leaves 4 and 5 are each provided with a row of perforations 8, extending all the way, across the respective leaf, in order to be able to remove them from the periodical 1 as a unit. A narrow strip 9 is left between the spine 3 and the perforations once the leaves are removed 8 so that the spine 3 is not damaged by removal of the adhered leaves 4 and 5.

Figure 2:
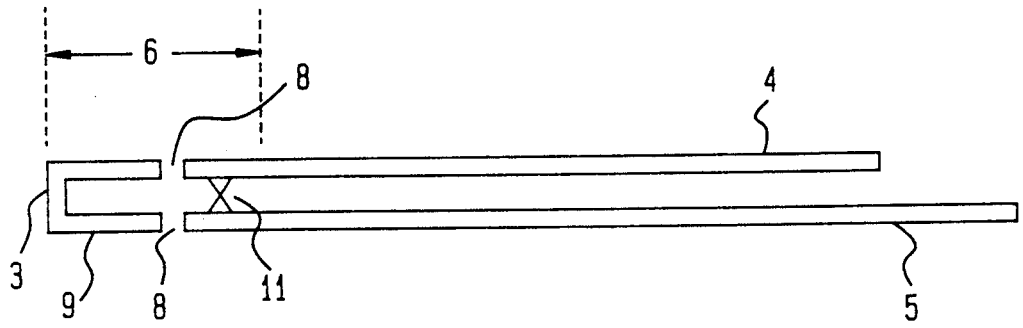
FIG. 2 is an enlarged section elevation of the adhered unit leaves.

As can be seen in FIG. 2, there is an adhesive 11 between the leaves 4 and 5, adhering them together at the strip 6. The adhesive 11 is spaced away from the spine 3 in the strip 6 beyond the perforations 8, so that after removal from the periodical 1, the leaves 4 and 5 remain adhered as a unit.

It will be seen that the upper leaf 4 is smaller than the lower leaf 5. The portion 10 of the lower leaf 5 which projects beyond the upper leaf 4 can have information printed on it, for example a code word and/or a special colour.

The items of information present on the leaves 4 and 5 which go to make up a unit can be read easily and clearly page by page because the leaves 4 and 5, as in a book or a periodical, can be studied and turned over even when they are held together in a binder by means of the holes 7 and are adhered at the binding edge. One can leave them in the binder for reading at will, but equally well one can remove them from it.

Figure 3:
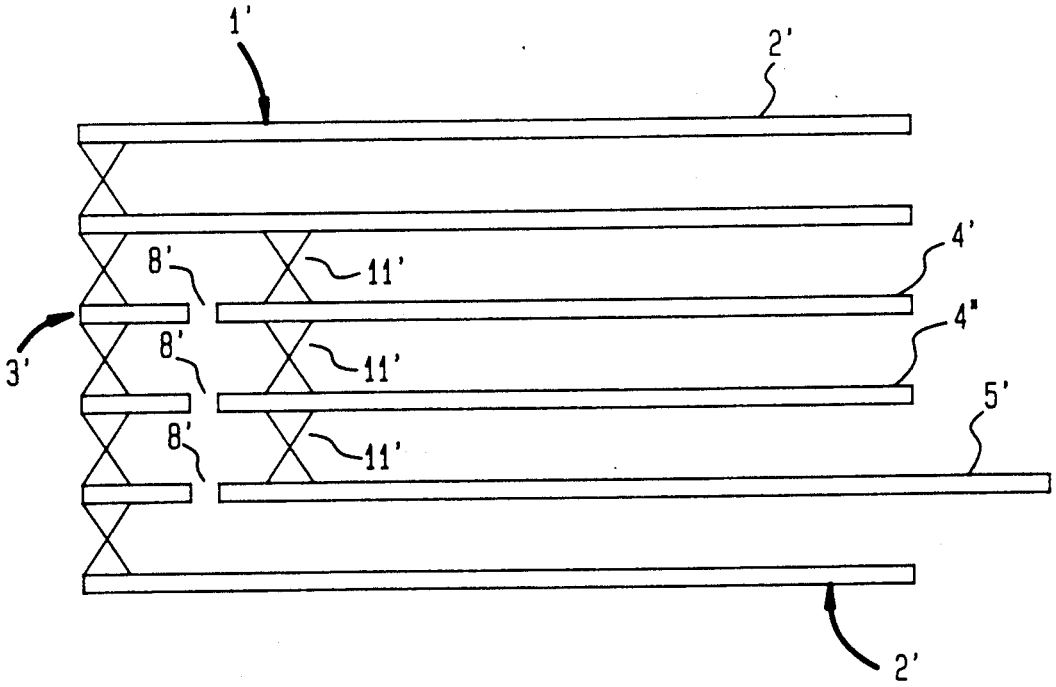
FIG. 3 is a cross-section of a modification of the periodical of the invention.

As can be seen in FIG. 3, periodical 1' contains leaves 2', 4', 4'', and 5' secured together at their spine end 3'. The leaves 4', 4'', and 5' are also provided with a line of perforations 8' spaced from the, spine edges of the leaves. These leaves are also adhered together at 11' to form the removable unit of the invention. In this modification each of leaves 4'' and 4'' are narrower than leaf 5'.

What is claimed is:

1. A printed work comprising a plurality of leaves bound together at their spine edges to form a book;

some of said leaves being fastened to each other by securing means placed at a location adjacent to their spine edges said leaves comprising a removable unit;

with each leaf of said removable unit further having a line of perforations extending parallel to its spine edge with said line of perforations being placed on each leaf between the securing means and the leaf spine edge such that the leaves can be removed from the book as a unit, while leaving a small strip of each leaf attached to the spine of the book.

2. The printed work according to claim 1 wherein one of the leaves of said unit is wider than any other leaf in the unit.

3. The printed work according to claim 1 wherein the leaves adhered together as a unit include at least two upper leaves and at least one lower leaf with said at least one lower leaf being wider than said at least two upper leaves.

4. The printed work according to claim 1 wherein the leaves adhered together as a unit comprise laterally offset superimposed and folded webs.

5. The printed work according to claim 1 wherein the leaves adhered together as a unit include attaching openings to allow the leaves to be bound together in a file.

* * * * *